US005252984A

United States Patent [19]

Dorrie et al.

[11] Patent Number: 5,252,984

[45] Date of Patent: Oct. 12, 1993

[54] MULTIBAND COAXIAL ROD AND SLEEVE ANTENNA

[75] Inventors: Horst Dorrie; Uwe Militz; Heinrich Wilken, all of Berlin, Fed. Rep. of Germany

[73] Assignee: Robert Bosch GmbH, Stuttgart, Fed. Rep. of Germany

[21] Appl. No.: 896,741

[22] Filed: Jun. 9, 1992

Related U.S. Application Data

[63] Continuation of Ser. No. 657,079, Feb. 19, 1991, abandoned, which is a continuation-in-part of Ser. No. 545,347, Jun. 27, 1990, abandoned.

[30] Foreign Application Priority Data

Jul. 5, 1989 [DE] Fed. Rep. of Germany ..... 3922042
Feb. 21, 1990 [DE] Fed. Rep. of Germany ... 9002022[U]

[51] Int. Cl.[5] ..... H01Q 9/22; H01Q 1/38; H01Q 5/00

[52] U.S. Cl. ..... 343/791; 343/897; 343/900

[58] Field of Search ..... 343/790–792, 343/715, 872, 900, 897

[56] References Cited

U.S. PATENT DOCUMENTS

| | | | |
|---|---|---|---|
| 2,158,376 | 5/1939 | Moser et al. | 343/791 |
| 3,031,668 | 4/1962 | Bryson | 343/790 |
| 3,789,418 | 1/1974 | Reiber et al. | 343/900 |
| 4,435,713 | 3/1984 | Gasparaitis et al. | 343/702 |
| 4,748,450 | 5/1988 | Hines et al. | 343/791 |

FOREIGN PATENT DOCUMENTS

| | | | |
|---|---|---|---|
| 1087190 | 8/1960 | Fed. Rep. of Germany | 343/900 |
| 2636523 | 2/1978 | Fed. Rep. of Germany | 343/790 |
| 475855 | 11/1937 | United Kingdom | 343/792 |

*Primary Examiner*—Michael C. Wimer
*Attorney, Agent, or Firm*—Frishauf, Holtz, Goodman & Woodward

[57] ABSTRACT

An elongated rod 11 of dielectric material, for example fiberglass—plastic or the like, has a central conductor (12) located coaxially therein, the conductor having a length $L=3/2\ \lambda$; in the central $\lambda/2$ range, the insulating rod is surrounded by a conductive layer (13, 16, 20, 25), for example of conductive lacquer, a mesh or braid of conductive material, a conductive foil or tube or the like. In the lower $\lambda/2$ region of L1, the bottom terminal of the central conductor will provide a high resistance output for the higher one of the frequency ranges which, for example, can be a radio telephone, or vehicular communication frequency of between 450–470 MHz. The entire antenna is suitable as an AM-FM/radio-telephone combination antenna. $\lambda$ is the median operating wave length of the higher one of the frequency ranges for which the antenna is suitable. Preferably, the antenna is covered with a sleeve of insulating material, for example a heat shrinkable plastic (27). The band width of the antenna can be extended by placing a further electrically conductive layer (513, 619, 722, 828) on the rod, spaced by a gap (a) physically and electrically from the conductive layer (13, 16, 20, 25) in the middle of the elongated rod. The further conductive layer is $\lambda/2$ long, and connected to the inner coaxial conductor (12, 512), which in turn can be coupled to an antenna input, for example the center conductor of a coaxial cable of a radio apparatus.

9 Claims, 2 Drawing Sheets

MULTIBAND COAXIAL ROD AND SLEEVE ANTENNA

This application is a continuation of application Ser. No. 07/657,079, filed Feb. 19, 1991, now abandoned, which is a continuation-in-part of Ser. No. 07/545,347, filed Jun. 27, 1990 now abandoned.

Reference to related application, assigned to the assignee of the present application, the disclosure of which is hereby incorporated by reference: U.S. Ser. No. 07/448,750, filed Dec. 11, 1989, Dorrie, now U.S. Pat. No. 5,057,849.

FIELD OF THE INVENTION

The present invention relates to a rod antenna to operate with multiply, e.g. two different frequency band ranges, and more particularly to a rod antenna suitable for attachment to a vehicle, which can operate to receive radio transmission in the frequency modulated (FM) and regular broadcast frequency bands, as well as a transceiver antenna for use in radio telephone communication and operating in the radio telephone band or bands or other radio communication.

BACKGROUND

Multi-range antennas, and particularly antennas suitable for radio communication as well as for broadcast or entertainment radio reception in the FM, short-wave, medium-wave and long-wave ranges are known, and one antenna of this type is described in the referenced application Ser. No. 07/448,750, filed Dec. 11, 1989 now U.S. Pat. No. 5,057,849. Antennas of this type have, basically, an elongated, usually essentially vertically or generally upwardly extending rod of a conductive element, for example a copper core, surrounded by insulating material to give it mechanical strength, for example fiberglass or similar elongated fibers in a suitable plastic binder. A protective cover sleeve, for example of rubber, vinyl, or other similar material may surround the entire rod antenna. Antennas of this type, as known, have a disadvantage in that the base portion of the antenna requires two terminals, one for the antenna reception conductor and the other for a grounding conductor. The grounded terminal, usually connected to the chassis of a vehicle, may require a separate connection. Mere push-in insertion is not sufficient since, otherwise, the radiating element is electrically insulated with respect to chassis.

THE INVENTION

It is an object to provide a multi-band or multi-frequency range, and particularly dual-range rod antenna suitable for radio broadcast, that is AM and FM reception, and mobile telephone use, which is so constructed that the attachment region or connection point of the antenna does not require a grounded terminal, and which can be so made that it has the same diameter over essentially its entire length or, at least, a smoothly tapering shape, providing a smooth outer circumference, without interruption.

Briefly, an elongated rod of dielectric material has an elongated electrical conductor therein, extending over essentially the entire physical length of the rod. The conductor has a physical length of 3/2 λ. Electrically, the antenna has three contiguous λ/2 portions. In the middle λ/2 range or portion, the dielectric rod is surrounded by a conductive coating or sleeve, which is electrically isolated from the conductor. The coating or sleeve has a physical length of λ/2. λ is defined as the average or median operating wave length of the higher frequency region of the multi-frequency range antenna.

In accordance with a feature of the invention, and which is particularly suitable when increased band width is of importance, the rod antenna can include a further conductive layer of a physical length λ/2, located longitudinally below the conductive coating or sleeve, which is separated spatially and electrically from the conductive coating or sleeve, the further conductive layer being coupled at its lower end with the lower end of the inner elongated electrical conductor.

The antenna has the advantage that it requires only one output terminal, namely the one to the central conductor. The antenna provides gain in the higher one of the two frequency ranges. This, for example, is within the mobile radio range of about 450 MHz. The bottom point of the inner conductor provides a high resistance terminal so that it can readily be coupled to or inserted in a standard vehicular push-in or snap-in terminal connector.

The radiator, over its entire length, may have at least approximately the same thickness, which substantially simplifies its manufacture. Additional insulation material, interposed between longitudinal portions of the radiator, is not necessary.

The antenna is particular suitable as a vehicular combination radio reception-radio telephone or radio transmission antenna, the radio reception being particularly adapted to the frequency modulation (FM) radio spectrum.

Typical frequencies are 500–1500 kHz and 87–108 MHz, for AM and FM radio reception and 450 MHz to 470 MHz for mobile, e.g. car telephone use.

DRAWINGS

DETAILED DESCRIPTION

Figure 1:
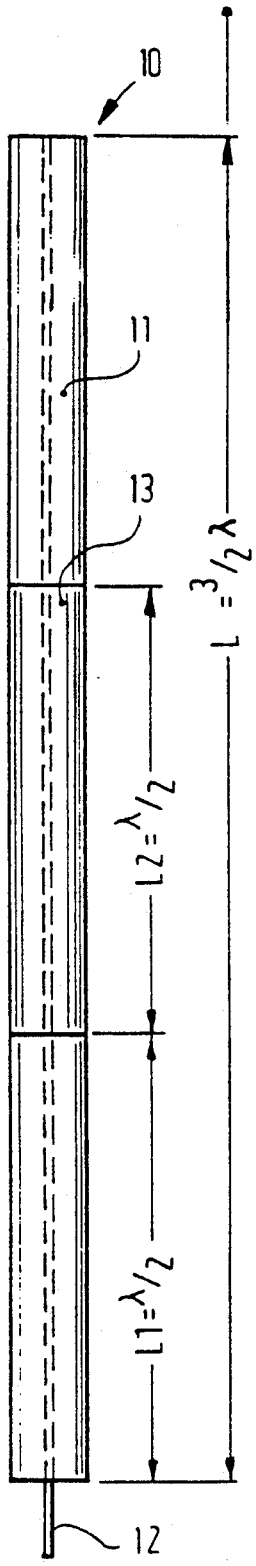
FIG. 1 is a side view of the antenna in accordance with the present invention, and showing dimensional relationships.

The rod-formed antenna of FIG. 1 is suitable for two frequency ranges, for example for radio or radio telephone operation and radio reception, for example and particularly in the FM band. The antenna is formed of a cylindrical rod 11 of dielectric material, for example glass fibers surrounded by or molded into a suitable plastic or glass-fiber reinforced plastic. A coaxial inner conductor 12 extends over the entire length of the antenna. The inner conductor 12 is left blank at the end, in FIG. 1 at the lower end, for coupling to a suitable antenna terminal, not shown, and which can be of any well known construction. The rod antenna has a physical length L of 3/2 λ. FIG. 1 illustrates the various length ranges or portions L1, L2 and L3, each λ/2 long. A conductive coating 13 is applied around the dielectric road 11 in the central range or portion L2, that is, between the lower range L1 and the uppermost range or portion L3. The conductive; coating 13 extending over the central range L2 is not coupled to ground, and is left unconnected. λ is defined as the median operating wave length of the higher one of the operating ranges of the antenna.

Operation:

For radio reception, the entire length L=3/2 λ of the antenna 10 is effective.

For vehicular or mobile radio use, which is in a substantially higher frequency range, for example in the range of between 450 to 470 MHz, only the lower one of the λ/2 regions, namely the lower portion L1, will be effective. In this region, the antenna terminal is at high resistance and, hence, does not require a ground or chassis terminal.

Figure 2:
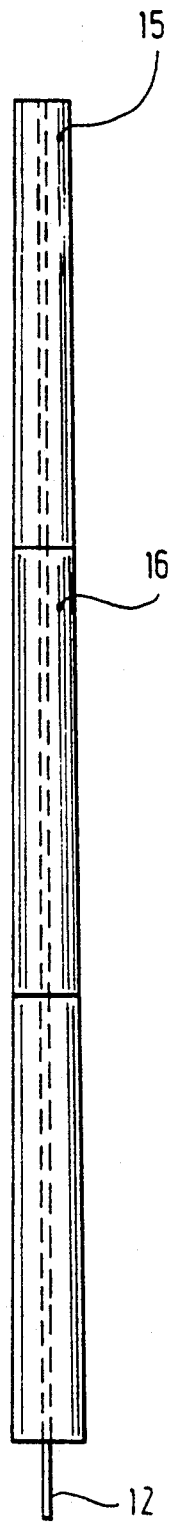
FIG. 2 is another embodiment of the antenna of FIG. 1.

The rod 10 need not be cylindrical, but can be slightly conical, as seen in FIG. 2. A conically tapering rod 15 is used which carries the conductive region 16 at its central portion. The length relationships are the same as in FIG. 1.

Figure 3:
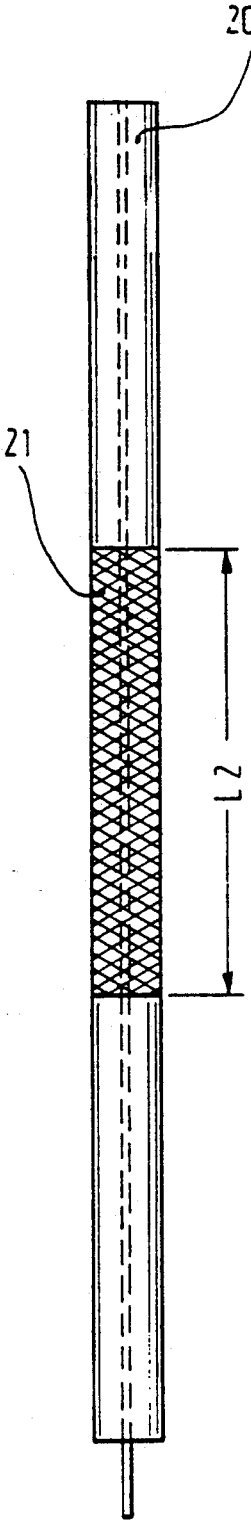
FIG. 3 illustrates yet a further embodiment of the antenna.

FIG. 3 illustrates an embodiment in which the conductive outer portion 13 or 16 (FIGS. 1 and 2) are formed by a conductive mesh, fabric or braid 21. The conductive mesh 21 can be pushed on the rod 20 which can be cylindrical or tapering. By longitudinally compressing the mesh, its effective diameter will be greater than the diameter of the rod 20 which, upon expansion over the length shown at L2, then will grip tightly around the rod 20.

Figure 4:
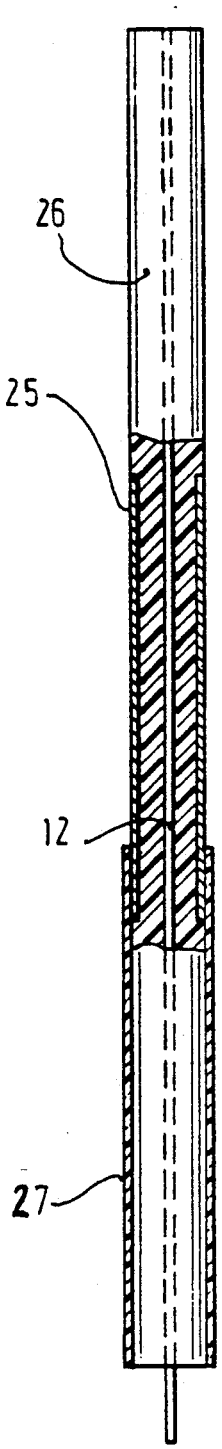
FIG. 4 is a part-sectional view of another embodiment of the antenna.

The conductive region 13 or 16 can also be formed by a thin foil or tube portion 25, see FIG. 4. The tube 25 is preferably made of foil material, for example copper. The copper foil can be placed in an injection molding machine so that it is embedded in the insulating material forming the rod of the rod antenna 26, thereby presenting a smooth outer circumference to the rod antenna 26 without any enlargement of diameter thereof. Region 13 can also be a conductive paint or lacquer.

In accordance with a preferred feature of the invention, an insulating tube or sleeve 27 is placed over the rod antenna. A suitable material is heat shrinkable plastic which is shown only in fragmentary form in FIG. 4.

Figure 5:
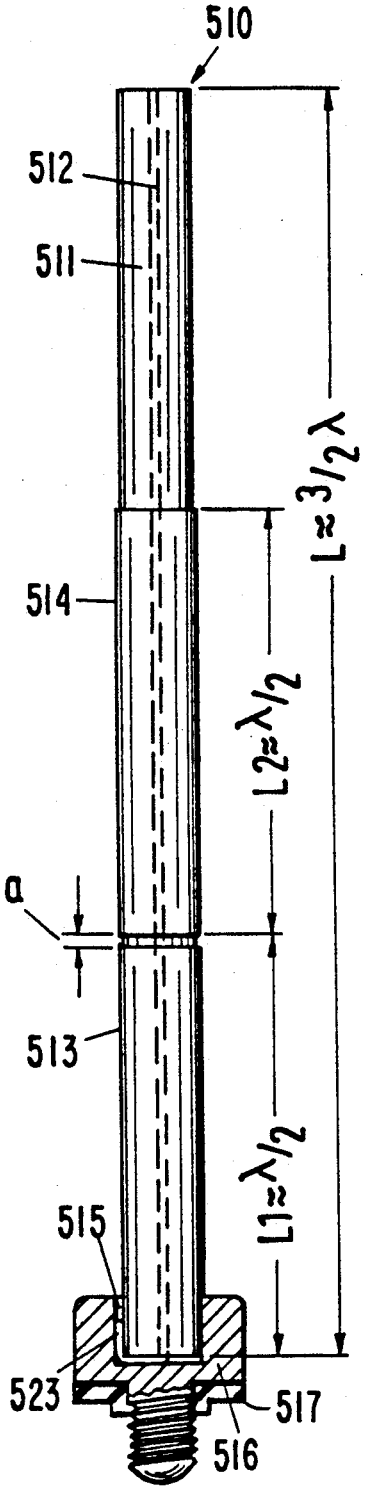
FIG. 5 is a side view of the antenna in accordance with the present invention suitable for wider band application than the antenna shown in FIG. 1.

If greater band widths are desired, the embodiments of FIGS. 5 to 8 are particularly preferred. FIG. 5 shows an antenna 510 which is suitable for commercial radio reception in the long-wave, medium-wave, short-wave as well as FM ranges. The antenna is similar to the antenna of FIG. 1, has a central conductor 512, which is centrally coaxially positioned within a cylindrical rod 511 of dielectric material, for example and preferably fiberglass. The inner or central conductor 512 extends over the entire length of the antenna. The rod 511 has a length of about 3/2 λ, in which λ is the median or average operating wave length of the shortest wave length for which the antenna is suitable. A lowermost portion of the rod 511, of a length of L1 of about λ/2, is covered with a first thin conductive coating or cover 513. In an intermediate longitudinal range of the rod 511, a second thin conductive coating or cover 514 is applied, having a length L2 of again about λ/2. The two conductive coatings 513 and 514 are spaced by a distance or gap a, so that the coatings are electrically insulated from each other.

The lower end of the rod 511 is received within a depression 515 of a threaded bolt 516, with which the antenna can be secured to a suitable wall, for example the chassis or a fender portion of the vehicle. The lower end 523 of the inner conductor 515 is bent about the end of the rod and, conductively connected to the first conductive coating 513 over antenna portion L1, for example by soldering. Alternatively, the conductive coating 513 can be carried around the lower end face of the insulating rod 511 and the end 523 of the inner conductor 512 can then penetrate through the coating or cover at the end face, be bent over radially, and form a conductive connection with the coating or cover 513.

The bolt 516 can pass, for example with an intermediate insulating washer 517 interposed, through a metallic wall, for example a chassis of the vehicle. The bolt 516 can then connect to a suitable antenna cable for the radio apparatus, for example to the center conductor of a coaxial cable.

Operation:

For radio reception, the entire length L of the antenna 510 is used, and effective. In the much higher frequency region, for example between 450 to 470 MHz, used for radio telephone communication, only the lower and the upper portions will be effective.

Figure 6:
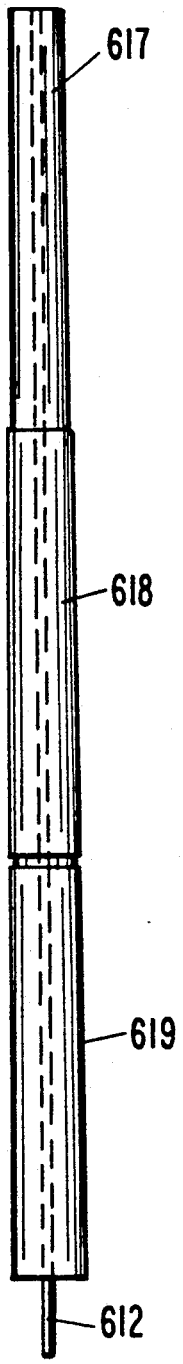
FIG. 6 is another embodiment of the antenna of FIG. 5.

FIG. 6 illustrates an antenna similar to FIG. 2, in which a slightly conically tapering rod is used, rather than an entirely cylindrical rod. The antenna 617 tapers conically upwardly and, likewise, has two outer conductive coatings 618, 619. The inner conductor 612 can be suitably connected, for example by a connector similar to connector 516.

Figure 7:
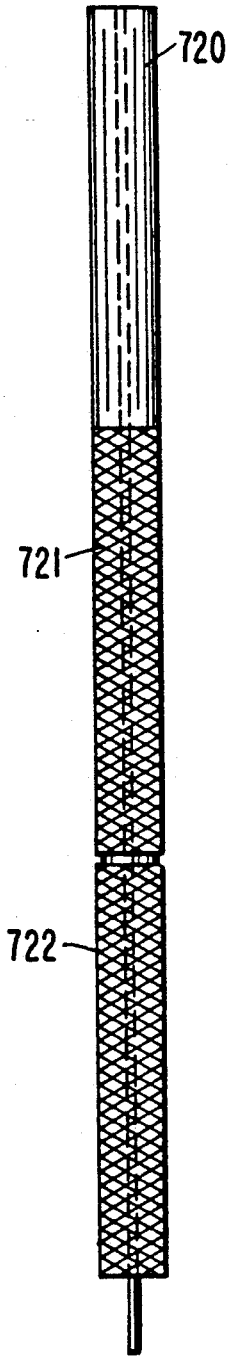
FIG. 7 illustrates yet a further embodiment of the antenna of FIG. 5.

FIG. 7 illustrates a rod antenna 720, which can be cylindrical or conical, and in which the outer conductive layers or coatings are formed by conductive mesh regions 721, 722. The conductive mesh portions 721, 722 can be pushed on the rod 720, for example, and then hold by self-contraction.

Figure 8:
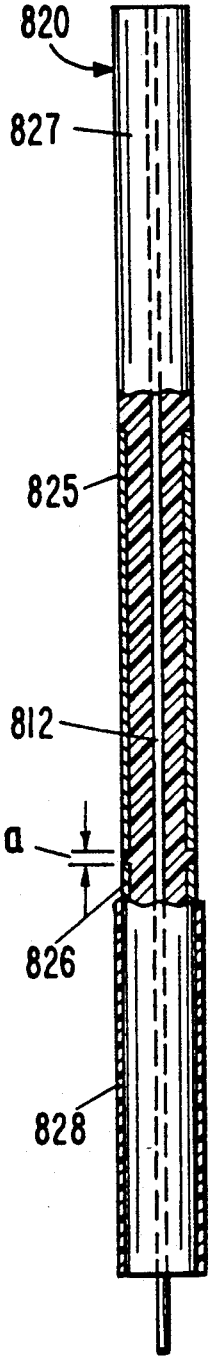
FIG. 8 is a part-sectional view of another embodiment of the antenna of FIG. 5.

The conductive layers or coatings 513, 514 can also be replaced by thin-walled tube portions 825, 826, as shown in FIG. 8 with respect to the antenna 820. These tubes, which may be formed of foils, are preferably made of copper and, when manufactured, can be placed in a mold which then has an injection-molding plastic material introduced, so that they can be made in one operating step. The foils or tube portions will be flush with the outer surface 827 of the rod antenna. A hose or tube of insulating material, preferably flexible insulating material to permit bending under wind loading, such as a shrink-applied plastic 828, can be placed about the antenna 820. The tubing 828 is shown foreshortened in FIG. 8, since it preferably extends over the entire length of the antenna and closes off the top as well.

A suitable diameter for the rod antennas 10, 15, 20, 26, 570, 617, 720, 826 is about 5 to 6 mm, for the antennas 15, 20, 26 and 617, 720, 826 preferably about 5.5 mm. The inner conductor, for example, can be a copper wire of 1 mm diameter, or a silvered rod of steel material, of for example 1 mm diameter, if increased wind resistance and bending strength is desired. Preferably, the respective conductive zones 13, 16, 21, 25, 513, 514, 618, 619, 721, 722, 825, 826 are so applied to the rod antennas that the outer surface is smooth, or essentially smooth, to facilitate placing the shrink tube 27, 828 thereover.

The conductive coatings 13, 513, 514, mesh 21, 721, 722 foils or tubes 25, 825, 826 are so thin that they hardly increase the diameter of the antennas; they, typically, are about 0.25 mm or less thick, so that the overall diameter of the rod is increased by only about 0.5 mm.

The two, electrically separated, electrically conductive regions 514, 513, 618, 619, 721, 722, 825, 826, which are separated electrically with respect to each other by the gap a, function, apparently, essentially like blocking sleeves, or may be considered as blocking sleeve resonators. The result will be that two antennas will obtain, effectively, a first antenna having the physical length $L=3/2\ \lambda$, suitable for radio, i.e. AM and FM radio reception; and a second antenna, which has the physical length $L1=\lambda/2$ and the upper equally long end of the antenna rod 511, and which is suitable for radio telephone communication.

Various changes and modifications may be made, and any features described herein may be used with any of the others, within the scope of the inventive concept.

We claim:

1. Vehicular multi-range rod antenna for combined use in the broadcast or radio frequency band ranges for amplitude-modulated (AM) broadcast radio reception and for frequency-modulated (FM) broadcast radio reception, and the mobile radio telephone frequency range of about 450 MHz to 470 MHz, wherein said mobile radio telephone range defines a medium wave length $\lambda$, said antenna essentially consisting of an elongated rod (511) of dielectric material, said elongated rod of dielectric material having a physical length $L=3/2\ \lambda$ and defining three contiguous one-third length portions (L1, L2, L3), each physically of $\lambda/2$ length;

a coaxial conductor (512) extending within the entire length of the rod, and having a physical length within said rod of $3/2\ \lambda$;

a first conductive outer layer (514, 618, 721, 825) surrounding said elongated rod of dielectric material (511), said first conductive outer layer having a physical length $L2=\lambda/2$ and being located in the middle third length portion (L2) of said elongated rod; and an additional conductive outer layer (513, 619, 722; 828) located at the lower third length portion (L1) of said elongated rod of dielectric material, said additional conductive outer layer having a physical length of about $\lambda/2$, being electrically connected to said coaxial conductor (512) and being electrically insulated with respect to said first conductive outer layer.

2. The antenna of claim 1, wherein said coaxial conductor (512) extends, at a lower end thereof, beyond the length of the elongated rod (511) to form an extending portion (523, 612);

and an electrical connection between said extending portion and said additional conductive layer (513, 619; 722; 828).

3. The antenna of claim 1, further including a terminal element (516) formed with a recess (515) therein, said rod being fitted in said recess, said terminal element (516) being electrically connected to said coaxial conductor (512) and adapted for transfer of electrical signals transduced by said antenna.

4. The antenna of claim 1, wherein the conductive outer layers comprise at least one of: a conductive paint; a conductive lacquer.

5. The antenna of claim 1, wherein said conductive outer layers comprise at least one of: an electrically conductive mesh; an electrically conductive braid.

6. The antenna of claim 1, wherein said conductive layers are tubular foil elements.

7. The antenna of claim 1, wherein said elongated rod of dielectric material (511) comprises a glass fiber rod.

8. The antenna of claim 1, wherein said elongated rod of dielectric material (617) conically tapers from the bottom to a tip region.

9. The antenna of claim 1, wherein said first conductive outer layer and said additional conductive outer layer, each, is essentially flush with the outer surface of said elongated rod of dielectric material.

* * * * *